United States Patent [19]

Roach

[11] Patent Number: 4,463,864

[45] Date of Patent: Aug. 7, 1984

[54] BASKET FOR RETAINING PARTS DURING HEAT TREATMENT

[75] Inventor: Maurice P. Roach, Waterloo, Iowa

[73] Assignee: Deere & Company, Moline, Ill.

[21] Appl. No.: 430,189

[22] Filed: Sep. 30, 1982

[51] Int. Cl.[3] ..... C21D 9/00; F27D 1/00; B65D 6/24

[52] U.S. Cl. ..... 220/4 F; 220/19; 220/83; 432/261

[58] Field of Search ..... 220/4 F, 19, 83; 432/261, 253

[56] References Cited

U.S. PATENT DOCUMENTS

| | | | |
|---|---|---|---|
| 1,903,310 | 4/1933 | Launderville | 220/83 |
| 2,145,258 | 1/1939 | Harris . | |
| 2,430,521 | 11/1947 | McCormick . | |
| 2,453,511 | 11/1948 | Jackson . | |
| 2,621,912 | 12/1952 | Lyon et al. . | |
| 2,710,746 | 6/1955 | Menough | 432/261 |
| 2,877,008 | 3/1959 | DeMattia | 432/261 |
| 3,498,597 | 3/1970 | Roberts et al. . | |
| 4,290,753 | 9/1981 | Klefisch | 432/261 |

*Primary Examiner*—George E. Lowrance

[57] ABSTRACT

An improved heat treating basket is disclosed for retaining parts on a heat treating tray as the parts are conveyed through a heat treatment process. The basket includes a plurality of side members attached together by connecting pins. Each side member has a thickness which tapers along the length thereof, on both an inner and an outer surface, to a narrow dimension located approximately halfway therebetween. The tapers equalizes the thermal gradient of the side member thereby prolonging the useful life of the heat treatment basket.

4 Claims, 4 Drawing Figures

BASKET FOR RETAINING PARTS DURING HEAT TREATMENT

FIELD OF THE INVENTION

This invention relates to an improved basket for retaining cast or machined parts on a tray as the parts are heat treated, and more particularly, to an improved basket constructed of side members having a taper along their length so as to equalize the thermal gradient thereof.

BACKGROUND OF THE INVENTION

In many applications, it is necessary that parts having various configurations and dimensions be heat treated to improve their material characteristics. In a normal heat treatment process, a part is heated to a high temperature, is held there for a period of time and thereafter is quenched, for example in an oil bath, to reduce its temperature quickly. In order to retain a plurality of parts, such that they can be properly heat treated, it has been standard practice to enclose the parts in a four-sided basket which rests upon a heat treating tray. The heat treating tray is placed on a conveyor system so that the parts can be easily moved into and out of the furnace and the quenching bath. Due to both the high temperature of the heat treatment process and the large temperature fluctuation which occur within a very short period of time, there is a tendency for thermal stresses to develop in the baskets. These thermal stresses can cause the basket sides to warp and crack after a period of time thereby making them unusable. Various attempts to alleviate this problem are described in U.S. Pat. Nos. 2,145,258; 2,430,521; 2,453,511; 2,621,912 and 3,498,597. These patents teach the use of flexible members which are used to make up the basket sides or the use of reinforcing members to make the sides more rigid. Despite these efforts, there is still a need to provide a heat treating basket which exhibits a longer useful life and is less susceptible to being warped and cracked during repeated use in the heat treating process.

Now an improved basket for retaining parts during heat treatment has been invented which solves the above mentioned problem.

SUMMARY OF THE INVENTION

Briefly, this invention relates to an improved basket for retaining parts on a tray as the parts are heat treated. The basket includes a plurality of side members attached together by connecting pins. Each of the side members has a thickness which tapers along its length, from both a front and a rear surface, to a narrow dimension located approximately halfway between opposite end surfaces. The taper equalizes the thermal gradient of the side member and thereby prolongs the useful life of the basket.

The general object of this invention is to provide an improved basket for retaining parts which are to be heat treated using side members, each having a taper along its length. A more specific object of this invention is to provide an improved basket constructed of side members, each having a taper along its length which narrows approximately at the mid-point thereof.

Another object of this invention is to provide an improved basket for retaining parts to be heat treated wherein the basket is constructed of side members, each having a taper which equalizes the thermal gradient along the respective side member.

A further object of this invention is to provide an improved heat treating basket which is simple in construction and is easy to assemble and disassemble.

Still further, an object of this invention is to provide an improved heat treating basket having unique side members which permit a rapid heat transfer from the parts contained in the basket to the quenching liquid surrounding the basket.

Still further, an object of this invention is to provide an improved heat treating basket which exhibits a prolonged useful life when compared to presently used baskets.

Other objects and advantages of the present invention will become more apparent to those skilled in the art in view of the following description and the accompanying drawings.

DETAILED DESCRIPTION OF THE PREFERRED EMBODIMENT

Figure 1:
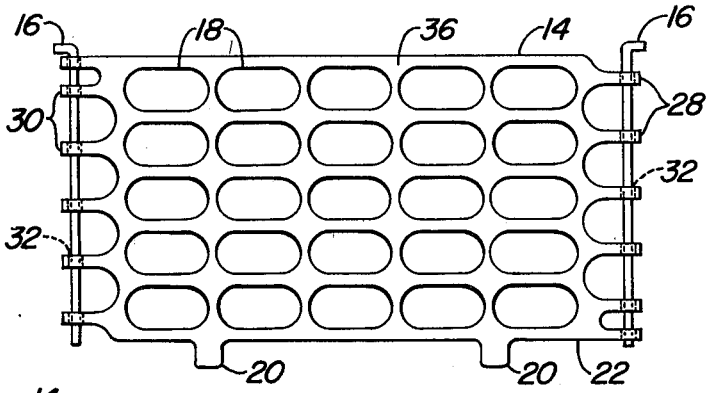
FIG. 1 is a front view of a side member of a heat treating basket including a pair of connecting pins.
Figure 3:
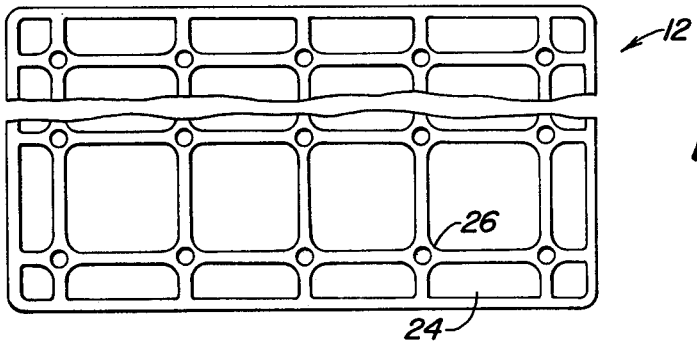
FIG. 3 is a top view of a heat treating tray on which the improved heat treating basket is positioned.
Figure 4:
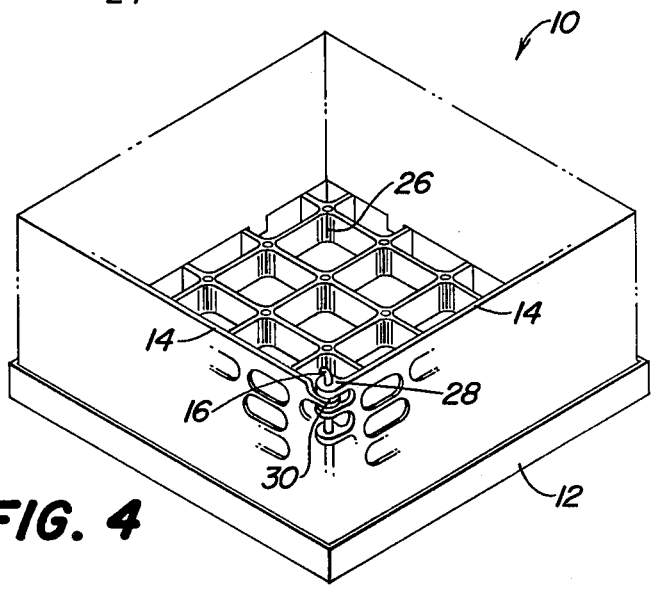
FIG. 4 is a schematic view of an assembled basket positioned on the heat treating tray.

Referring to the drawings, particularly FIG. 4, an improved heat treating basket 10 is shown positioned on a heat treating tray 12. The basket 10 is constructed of a plurality of side members 14 which are joined together at their ends by removable connecting pins 16. Each side member 14, best shown in FIGS. 1 and 2, has a rectangular or square configuration with an open network. The open network is obtained by providing a plurality of openings 18 throughout the cross section of the side member 14. It should be noted that the openings 18 can have various configurations such as circles, ellipses, ovals, etc., with the only limitation being the non-existence of sharp corners. The presence of sharp edges or corners can create high stress points which are detrimental to the life expectancy of the member. Along with the openings 18, each side member 14 contains at least one and preferably two downwardly extending projections 20. The projections 20 extend downward from a bottom surface 22 and are designed to mate with openings 24 formed in the heat treating tray 12. As is readily apparent from the alignment between FIGS. 1 and 3, the projections 20 are much smaller in size than the openings 24. This dimensional difference permits side members of various sizes and shapes to be assembled and positioned on the heat treating tray 12. It should be noted that the heat treating tray 12 includes an open grid 26 which facilitates the handling of different sized parts as well as being able to support a flat separator on which small parts can be placed.

Referring again to FIGS. 1 and 2, each side member 14 includes a plurality of right- and left-hand fingers 28 and 30 which extends outwards in a generally horizontal plane on the right and left ends respectively. Each of the fingers 28 and 30 contain a bore 32 which is arranged perpendicular to the longitudinal axis of the fingers 28 and 30. The bores 32, formed in the fingers 28, are coaxially aligned so as to be capable of receiving one of the connecting pins 16. The bores 32, formed in the fingers 30, are likewise coaxially aligned so as to be capable of receiving a second pin 16. It should be noted that four side members 14 can be connected together by four pins 16 to form a basket 10, although it is possible to connect three or more sides together to form an odd-shaped basket.

Figure 2:
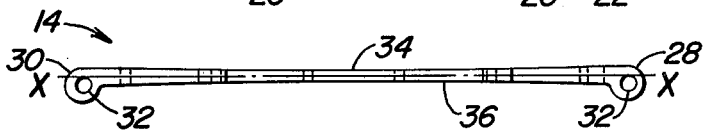
FIG. 2 is a top view of FIG. 1 without the connecting pins.

Referring now to FIG. 2, each side member 14 further contains an outside surface 34 and an inside surface 36. Both surfaces 34 and 36 converge symmetrically toward each other, relative to a vertical plane X—X passing through the respective side member 14 starting from the right and left ends such that the thickness of each side member 14 narrows to a thin portion located approximately halfway between the right and left ends. The slope on the surfaces 34 and 36 is preferably gradual and consistent from the ends inward to the midsection. The taper that is formed reduces the thickness of each of the side members 14 by approximately 10 to 50 percent and more preferably, by approximately 25 percent. The taper equalizes the thermal gradient of the side member 14 along its length such that the temperature at the center of the end portions of a side member 14 will be approximately equal to the temperature at the center of the middle portion of the side member 14. By obtaining a consistent temperature gradient across the entire length of each of the side members 14, the warping, buckling and cracking of each side member 14 can be minimized. Minimizing such destructive action prolongs the useful life of the basket 10 to the extent that it can even be doubled. Also by equalizing the thermal gradient along each of the side members 14, the thermal stresses, which are imparted into each of the side members 14 as they undergo rapid temperature variations, are reduced.

In order to facilitate the connection of one side member 14 to another, each side member 14 has the fingers 28 vertically offset from the fingers 30. This offset permits a connecting pin 16 to join two side members 14 together while permitting the bottom surfaces 22 of each of the side members 14 to lie in the same horizontal plane.

It should also be noted that typical heat treating baskets exhibit cracking in the vertical plane midway between the ends of a side member. However, when the baskets are used in different applications, it may be advantageous to taper the vertical sides of the side members 14 so as to reduce cracking in the horizontal plane. Such a feature is viewed as being encompassed by this invention.

While this invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. An improved basket for retaining parts on a tray as said parts are heat treated, said basket including a plurality of side members attached together by removable connecting pins, wherein said improvement comprises:

(a) side members of rectangular configuration each having first and second surfaces with a plurality of openings formed therethrough, each side member having distally spaced projections extending downward from a bottom edge, said projections engaging openings formed in said tray, and each of said side members having a first thickness which tapers along the length of both said first and second surfaces in a gradual symmetrical fashion to a narrow dimension located approximately halfway between said ends, with the change in thickness resulting in a more uniform thermal gradient and hence in the occurrence of reduced thermal stresses being imparted across each of said side members; and (b) a plurality of fingers arranged in a generally horizontal plane and projecting outward from opposite ends of said side members in a vertically offset arrangement, each of said fingers having a bore formed therethrough such that said bores at each end are coaxially aligned, said bores at each end receiving one of said connecting pins once said fingers of one side member are interleaved with said fingers of a second side member so as to retain said bottom edges of each of said side members in a single horizontal plane.

2. The improved basket of claim 1 wherein each side member is tapered in both the horizontal and vertical plane.

3. The improved basket of claim 1 wherein said narrow dimension is approximately 10 to 50 percent of its thickest dimension.

4. The improved basket of claim 3 wherein each narrow dimension of a respective side member is approximately 25 percent of its thickest dimension.

* * * * *